US006574934B1

(12) United States Patent
Queirel

(10) Patent No.: US 6,574,934 B1
(45) Date of Patent: Jun. 10, 2003

(54) BLOCK FORMING DEAD FORM WORK ELEMENT FOR A REINFORCED CONCRETE WALL

(76) Inventor: Joel Queirel, 39, rue Jules Lebocey, 10000 Troyes (FR)

( * ) Notice: Subject to any disclaimer, the term of this patent is extended or adjusted under 35 U.S.C. 154(b) by 0 days.

(21) Appl. No.: 09/980,883

(22) PCT Filed: May 30, 2000

(86) PCT No.: PCT/FR00/01484

§ 371 (c)(1),
(2), (4) Date: Dec. 6, 2001

(87) PCT Pub. No.: WO00/75462

PCT Pub. Date: Dec. 14, 2000

(30) Foreign Application Priority Data

Jun. 8, 1999 (FR) ..... 99 07194

(51) Int. Cl.[7] ..... E04B 2/00
(52) U.S. Cl. ..... 52/424; 52/425; 52/426
(58) Field of Search ..... 52/424, 425, 426, 52/169.7, 576

(56) References Cited

U.S. PATENT DOCUMENTS

| | | | | |
|---|---|---|---|---|
| 2,973,931 A | | 3/1961 | Brown | |
| 3,610,564 A | | 10/1971 | Mattingly | |
| 3,664,271 A | | 5/1972 | Wolder et al. | |
| 4,577,447 A | * | 3/1986 | Doran | 52/571 |
| 4,743,414 A | * | 5/1988 | Sudrabin | 264/35 |
| 4,825,617 A | * | 5/1989 | Kinoshita et al. | 52/396.01 |
| 5,107,648 A | * | 4/1992 | Roby | 52/309.12 |
| 5,383,311 A | * | 1/1995 | Strickland | 52/20 |
| 5,465,542 A | * | 11/1995 | Terry | 52/309.7 |
| 5,570,550 A | * | 11/1996 | Roby | 52/309.12 |
| 6,151,857 A | * | 11/2000 | Raschke | 52/426 |
| 6,378,261 B1 | * | 4/2002 | Agsten | 52/426 |
| 6,389,758 B1 | * | 5/2002 | Martin, Jr. | 52/125.2 |
| 6,401,413 B1 | * | 6/2002 | Niemann | 52/309.12 |
| 6,408,581 B2 | * | 6/2002 | Monachino | 52/247 |

FOREIGN PATENT DOCUMENTS

| | | |
|---|---|---|
| FR | 2 662 722 A1 | 12/1991 |
| FR | 2 724 681 A1 | 3/1996 |
| FR | 2 778 933 A1 | 11/1999 |

* cited by examiner

*Primary Examiner*—Carl D. Friedman
*Assistant Examiner*—Kevin McDermott
(74) *Attorney, Agent, or Firm*—Rothwell, Figg, Ernst & Manbeck

(57) ABSTRACT

The invention relates to a block forming a dead form work element for the construction of a mechanically resistant concrete wall. The block essentially comprises two parts (1*a*, 1*b*) which can be assembled, each part consisting of a main surface (10*a*, 10*b*) which is integral with and acts as the starting point on one side for bracing elements in the form of a shaft (11*a*, 12*a*, 13*a*, 14*a*, 14*b*), whereby said parts when assembled rest against each other and interlock via the ends of the bracing elements. The invention can be used to improve the construction of swimming pools.

12 Claims, 7 Drawing Sheets

BLOCK FORMING DEAD FORM WORK ELEMENT FOR A REINFORCED CONCRETE WALL

This application is a 35 U.S.C. §371 National Phase entry of International Application No. PCT/FR00/01484, filed May 30, 2000, and designating the United States.

This invention relates to a block forming a dead form work element for a reinforced concrete wall, particularly for the construction of Civil Engineering works such as swimming pools or water tanks, which can be equipped with a liner (watertight inner pocket), since such works must comprise a mechanically-resistant reinforced concrete wall.

Many dead form work manufacturing processes and devices for the building of such works are already known.

Some processes use, for instance, dead form structures along the total height of the wall to be built, juxtaposed and assembled with one another by various means. Such form structures usually tend to be unpractical, their versatility of use is extremely limited, they are very costly, much too bulky for storage and transport purposes, and generally not suitable for the construction of a perfectly watertight continuous concrete wall.

In his prior patents FR 94 11182 and FR 95 01853, the applicant already described panels forming dead form structures for the building of such works. Said panels comprise essentially two surface sheets held together by means of bracing structures regularly distributed and attached between the two sheets, while leaving spaces between them to allow for the passage of the metal reinforcements and the on-site pouring of the concrete. Such panels constitute already quite a significant progress over the prior art, allowing in particular for a great versatility of use and necessitating less concrete. Yet, they do require, for the installation of the various elements of the swimming pool such as water inlet and outlet fittings and other equipment as well as for the installation of the liner, extensive work for the preparation and positioning of these devices on/or through the wall of the work.

In his prior patent FR 98 06382, the applicant also described a panel forming a dead form structure made of elementary blocks formed with two parts that can be assembled, each one having a main face on which bracing elements are integrally fastened on one side thereof, said two parts designed to bear on each other in the assembling position via the free extremities of said bracing elements. These two parts can fit inside each other when their respective position is inverted, so as to minimize bulk during storage or transport.

This invention relates to a block that somehow represents a synthesis of the two prior types of construction, while adding many other advantages, especially as to the ease and security of use, in particular regarding the installation, the sealing and the ease and precision of the setting of all the pool elements and operating pieces of equipments.

To this effect, an elementary block forming dead form structure, in particular for the building of Civil Engineering works, especially swimming pools or water tanks requiring a mechanically-resistant concrete wall, is, during use, in the shape of a rigid block, essentially a rectangular parallelepiped, with a hollow volume between its two opposite main faces to allow for the pouring of the concrete. Said elementary block consists essentially of two parts that can be assembled, each one comprising said main face with, integrally fastened on one side thereof, regularly distributed bracing elements. Said two parts come to bear on each other and to interlock in the assembling position via the free extremities of said bracing elements. According to a characteristic of this invention, said bracing elements are in the shape of a shaft with an essentially cylindrical section and with an occupancy volume of essentially at least 40% of the volume of the block and preferably about at least 45% of this volume.

Advantageously, said two parts of the elementary block are identical, their assembling and interlocking being carried out by complementary organs facing one another when said identical parts are brought together but rotated at 180° relatively to one another, the adjacent elementary blocks interlocking by simply bearing onto one another by means of complementary locking means provided in particular on their edge.

According to an advantageous characteristic of this invention, the bracing elements in the shape of shafts with an essentially cylindrical section are designed with a polygonal section and occupy the major part of the block width. This configuration allows for a better resistance, for a same weight of matter, of the mechanical block consisting of these two interlocked parts and facilitates the connecting-interlocking of these two parts.

According to another characteristic of this invention, each elementary block comprises at its upper edge a recess in the shape of a groove for the hooking of the liner.

Advantageously, in a block forming element of a wall of the casting concrete along the height of the work wall, each said part of the block comprises several said bracing elements, lined up along the height, and a canal capable of housing a seal along the height and the edge of said part, this seal being compressed by the complementary edge in the next adjacent similar block.

This invention and its implementation, as well as its many advantages and characteristics, will become more apparent from the following description, together with the accompanying drawings showing one of its embodiments.

Figure 1:
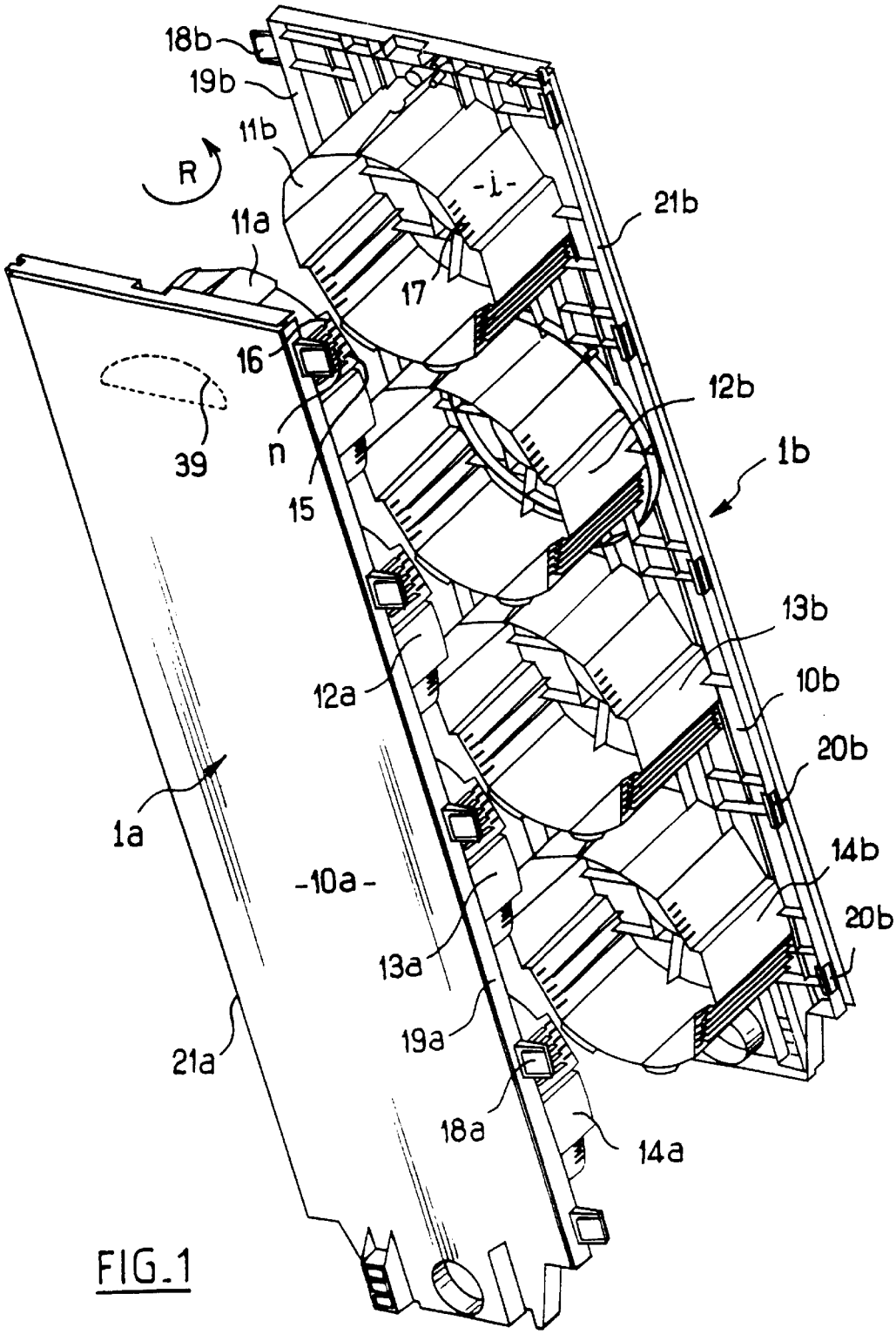
FIG. 1 is a perspective view of two identical parts before they interlock, shown in the position where they are about to interlock, to form the elementary block of the dead form structure according to this embodiment of the invention.
Figure 2:
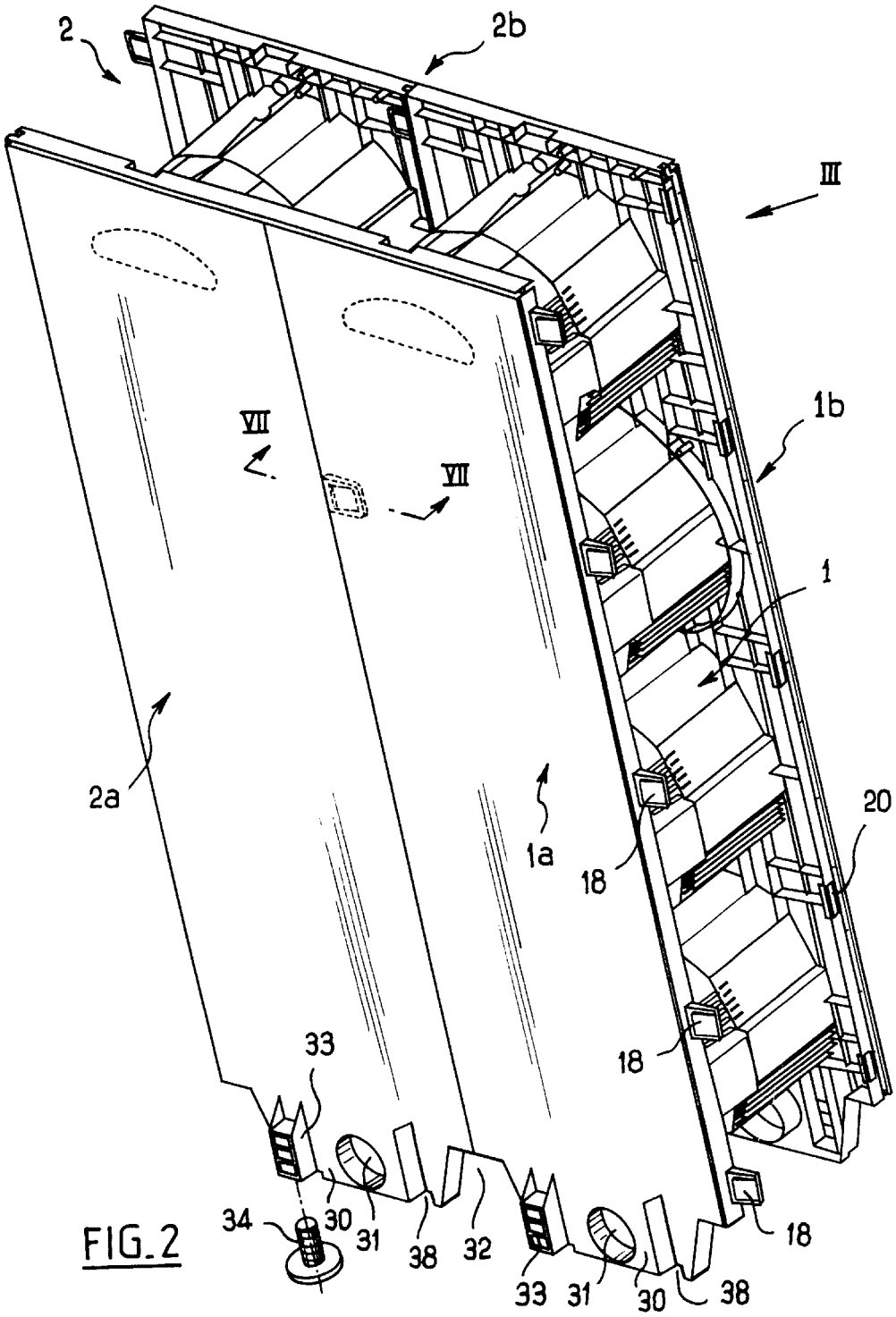
FIG. 2 shows the same two blocks forming a dead form structure element as in FIG. 1, but on a smaller scale, said blocks comprising two parts, the four parts being thus assembled into one form structure wall element consisting of two adjacent elementary blocks.

The description of the main parts as well as their elements and members that constitute an elementary dead form structure block is made in reference to FIGS. 1 and 2.

FIG. 1 shows two parts 1*a* and 1*b* that can be assembled as shown in FIG. 2 to form an elementary block 1 of the dead form structure. This elementary block 1, shown assembled in FIG. 2, is also therein assembled to a second elementary block 2 consisting of two parts 2*a*, 2*b*.

Figure 5:
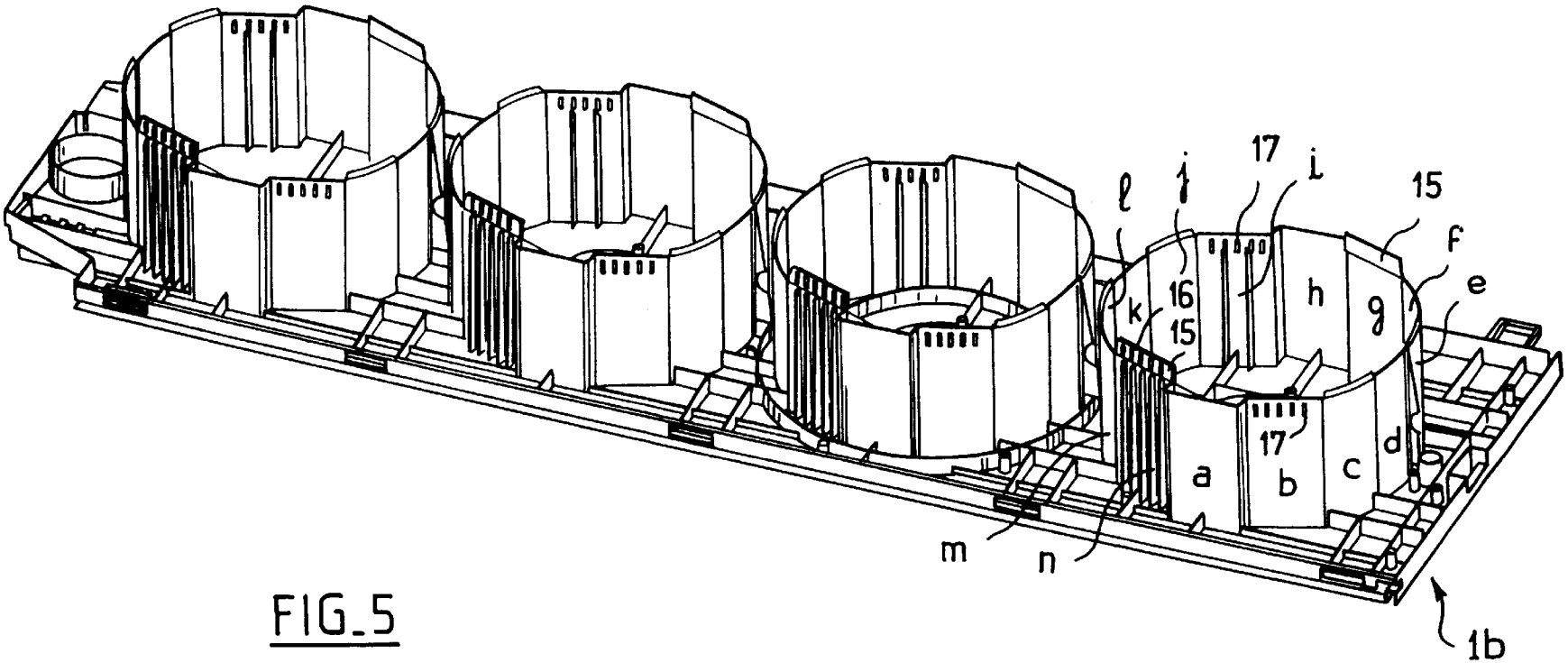
FIG. 5 is a perspective view from the inside of part of an elementary block before it is assembled to another identical part.

FIG. 1 shows clearly that the two parts 1*a* and 1*b* are identical, manufactured for instance by molding in a suitable plastic material such as polypropylene (PP), polystyrene or terephtalate polyethylene (TPE), the part 1*b* being identical to the part 1*a* after a simple 180° rotation in the direction indicated by the arrow R so that its bracing elements, integral with each main face of the part 1*a* or 1*b*, may come to interlock correspondingly. More precisely, using the reference 10, which becomes respectively 10*a* and 10*b*, for the main face, essentially plane, of each part 1*a*, 1*b*, the inside of this face, in the assembling position of the elementary block 1, is integrally equipped with bracing elements. In the example shown here there are four such elements, respectively 11*a*, 12*a*, 13*a*, 14*a* for the part 1*a* and 11*b*, 12*b*, 13*b*, 14*b* for the part 1*b*. As can be clearly seen on FIG. 1, such bracing elements are essentially in the shape of cylindrical shafts with a polygonal section and occupy most of the width of the element, e.g. about 70 to 80% of such width, while centered on the longitudinal median plane of the elementary block. In the illustrated example, and as shown more clearly in FIG. 5, each shaft is designed as a polygon with fourteen sides referenced a) to m), some of which, such as sides g) and n), comprise protruding tongues 15, equipped with teeth 16, that will catch, and engage in, the corresponding hollows or openings 17 of the complementary part (sides b) and i)) with which the represented part will be assembled to form an elementary block, i.e., supposing that the part 1*b* was represented in FIG. 5: the part 1*a*. In FIG. 1, only the side of the wall n) of the shaft 11*a* was referenced, so as not to overprint the drawing. The teeth 16 of said shaft 11*a*, designed on the tongue 15, will interlock with the hollows 17 formed on the side i) of the corresponding shaft 11*b*.

The construction thus described will allow a quick and convenient assembling of each elementary block such as 1, formed with two identical parts 1*a*, 1*b* positioned to face each other, by simple latching and will provide this elementary block with a great rigidity and resistance to crushing given its polygonal cylindrical shape that is ridged, castellated and lightly stepped radially, as shown in the drawings.

Once an elementary block 1 is thus formed, the interlocking and assembling of the contiguous blocks to form a continuous, watertight wall are very easily obtained by simple docking, by means of the elastic clips 18 (referenced 18*a*, 18*b* in FIG. 1, on the respective parts 1*a*, 1*b*) on a longitudinal border 19*a*, 19*b*, forming locking structure and entering complementary housings 20 (visible in 20*b* in FIG. 1) on the other longitudinal border 21 of said part of the elementary block (shown as 21*a*, 21*b* for part 1*a* and 1*b* respectively in FIG. 1).

Figure 3:
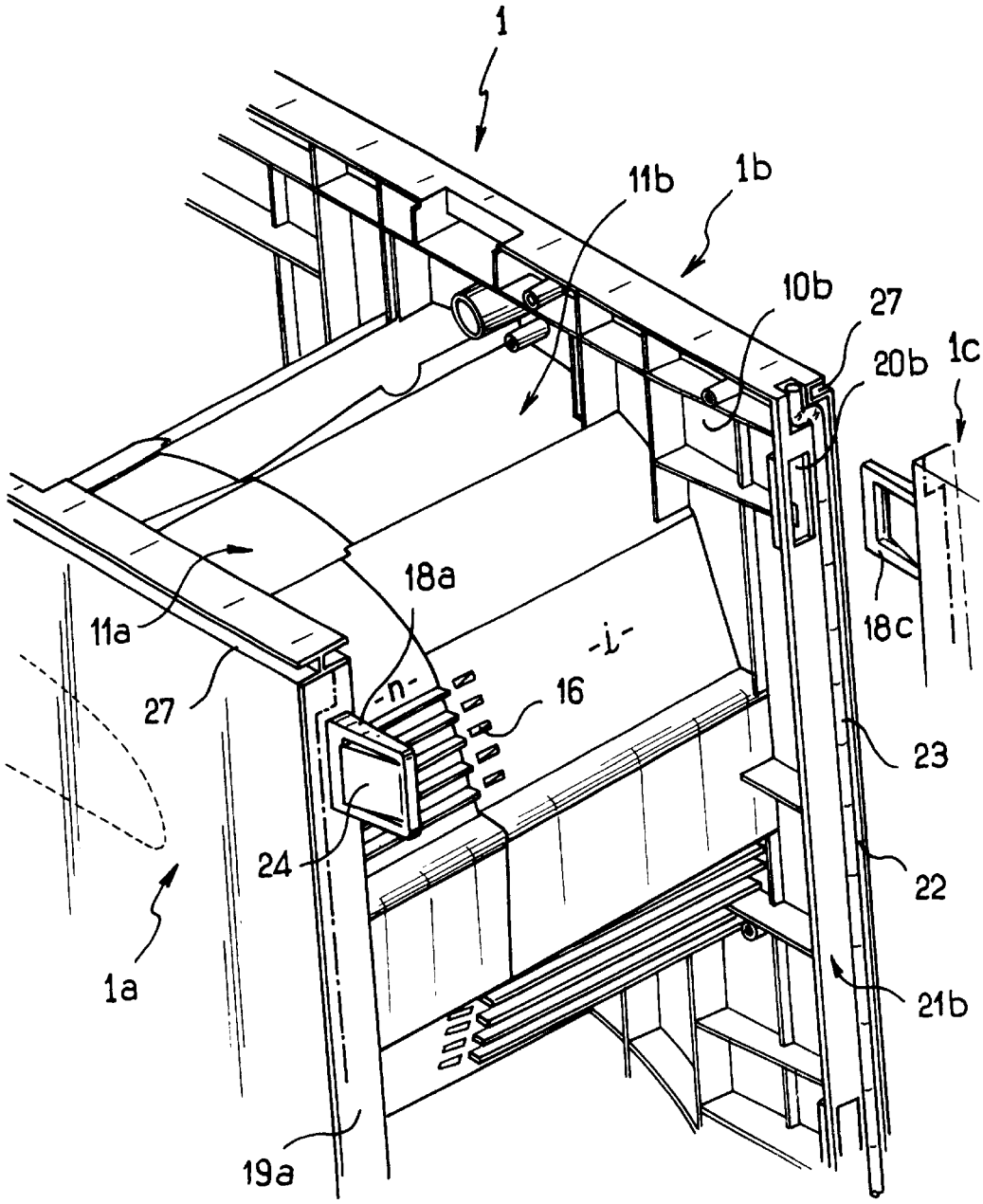
FIG. 3 is an enlarged perspective view seen along the angle indicated in III on FIG. 2.

FIG. 3 shows more details on the docking/locking of a clip 18*c*, of a part 1*c* in a housing 20*b* of the adjacent part 1*b* of the block 1. FIG. 3 also shows the teeth 16 of a wall n) of the shaft 11*a* getting locked in the corresponding hollows of a wall i) of a shaft 11*b*.

Figure 7:
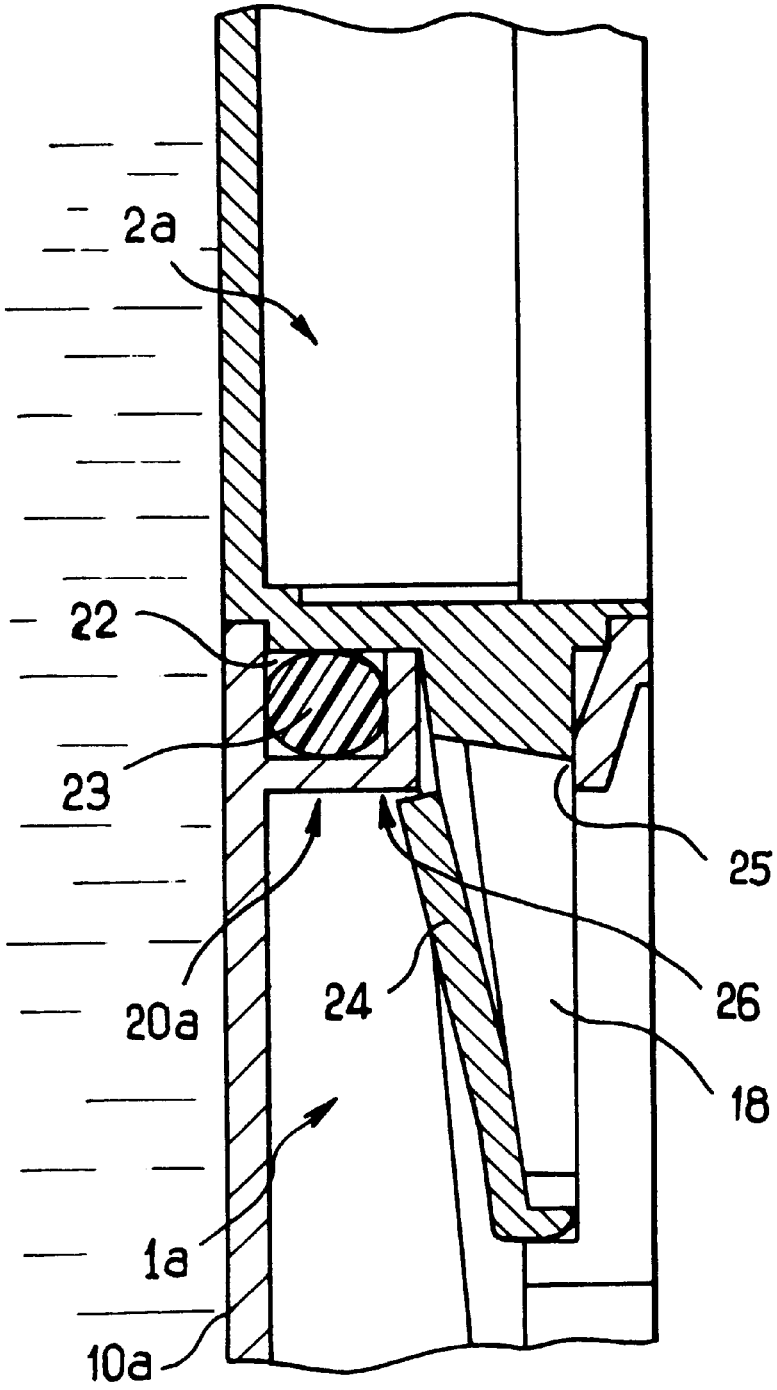
FIG. 7 is an enlarged sectional view of a detail showing the locking and the sealing between two adjacent blocks, taken along the section VII—VII in FIG. 2.

To insure sealing at the junction between two panels, a canal 22 is designed to house a watertight seal 23 (see also FIG. 7) on the panel longitudinal border such as 21*b*, i.e. the border along the panel height in the installation position of the panel. FIG. 7 shows an elastic clip 18 of the part 2*a* of the panel 2 engaged in the corresponding hollow housing 20*a* of the part 1*a* of the panel 1, the engagement and the locking being obtained automatically because of the elasticity of the configuration and the incline of the part 24 of the clip 18 which, when engaged into the opening 25 of the housing 20*a*, retracts and slackens after the complete engagement of said clip 18 in its housing, behind the return 26 of said housing. FIG. 7 also shows that this is where the canal 22 goes through for the housing of the seal 23.

Back to FIG. 3, it is clear that the seal 23, at the upper part of the block, follows the contour of a recess 27 formed on the main face 10*b* of the part 1*b*, on the outside of the block. This recess 27 will be used to hook up the liner upper edge if this is the panel side that faces the pool water. The symmetry of the construction allows indeed for the panel to be positioned either on one side or the other, since the upper part of the part 1*a* is also designed with the recess 27.

FIG. 3 also displays a dot-and-dash line on the border 19*a* to indicate the trace resulting from the squashing of a seal such as 23 when a contiguous panel [not represented] is set in position, together with its seal, in its corresponding canal 22.

Once assembled by juxtaposition in the vertical position essentially shown in FIG. 2 to form a wall of a pool dead form structure, the elementary blocks may be, for instance, about 1.20 m. high and about 30 cm. wide. Their bottom is designed with feet such as 30 on which they will rest at the bottom of the excavation dug to house them. Said feet are designed with holes such as 31, 32, to let through the reinforcing rods and to allow for the pouring of the concrete, advantageously simultaneous with the pouring of the concrete of the apron (not represented). Each foot comprises also, protruding on its side, a housing 33 designed to receive a lift jack 34 to be screwed to the housing 33 to allow for vertical adjustment. Each elementary part of the wall may comprise in a suitable location a small integrated level gauge (not represented) for a quick check of horizontality and verticality.

Figure 6:
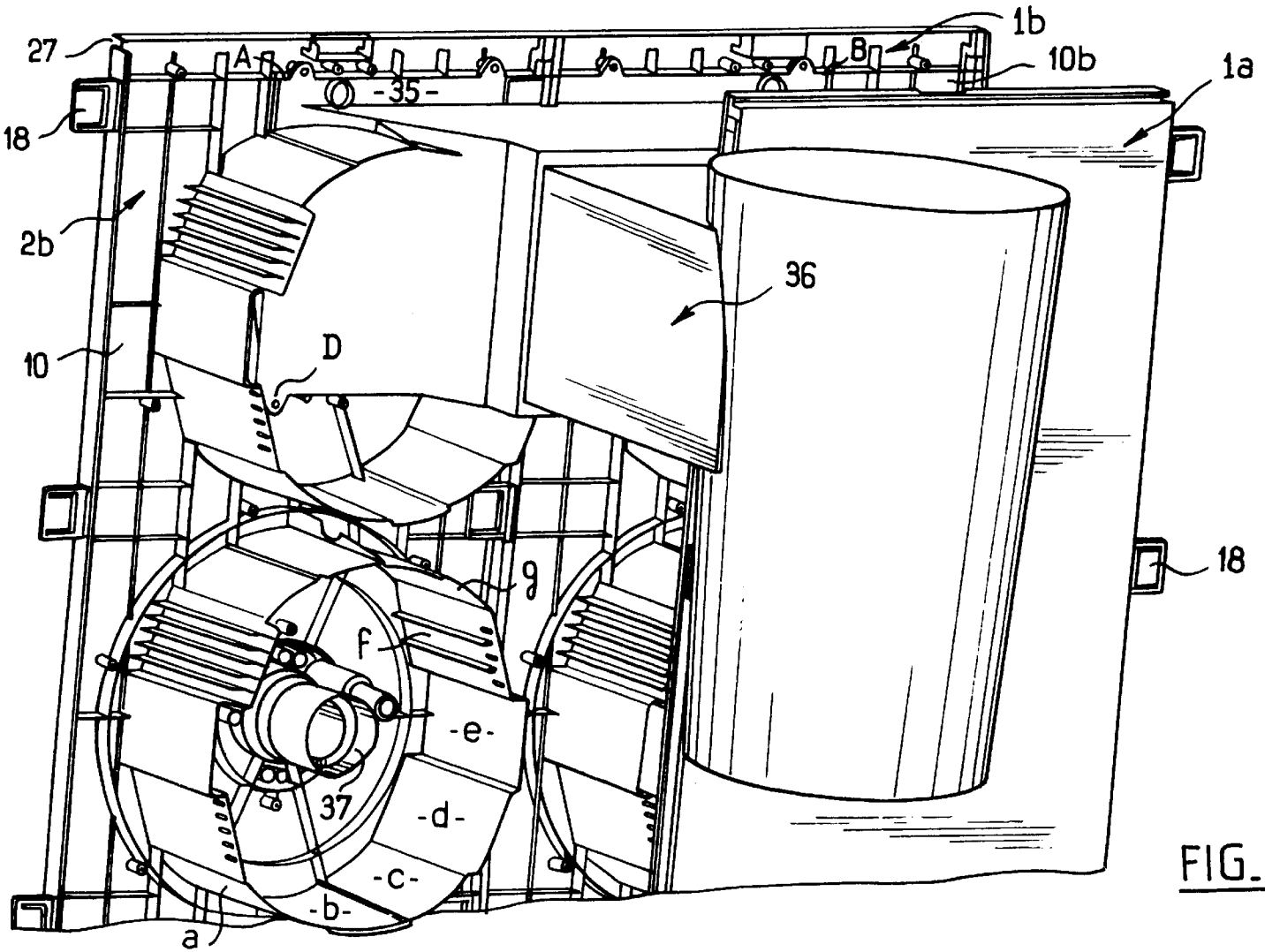
FIG. 6 is an enlarged and partially cut-away perspective view showing how it will be possible to fasten on, and insert in, the elementary blocks according to this invention various members such as a surface skimmer structure and a nozzle for the water return line by punching through scored parts designed on the main surface of the two parts of an elementary block.

FIG. 6 shows that, on the inner face of its main surface, each part of an elementary block displays a crisscross pattern and various markings that will actually be slightly visible on the outside. These markings, in suitable locations, enable to break through a part of the wall in order to receive the various operating components of the pool. Thus, as shown in the illustrated example of FIG. 6, astride two elementary blocks 1, 2, it is possible to break through a rectangular part of which are visible three of the angles A,B,D, to receive a water inlet 35 of a surface skimmer 36 that can be positioned directly in the form work panel before pouring the concrete. Likewise, a water outlet 37 is shown engaged by breaking through the central part of the second (from the upper edge of the panel) shaft of the elementary block 2. FIG. 6 shows also the groove 27 that will allow the hooking of the liner.

Figure 4:
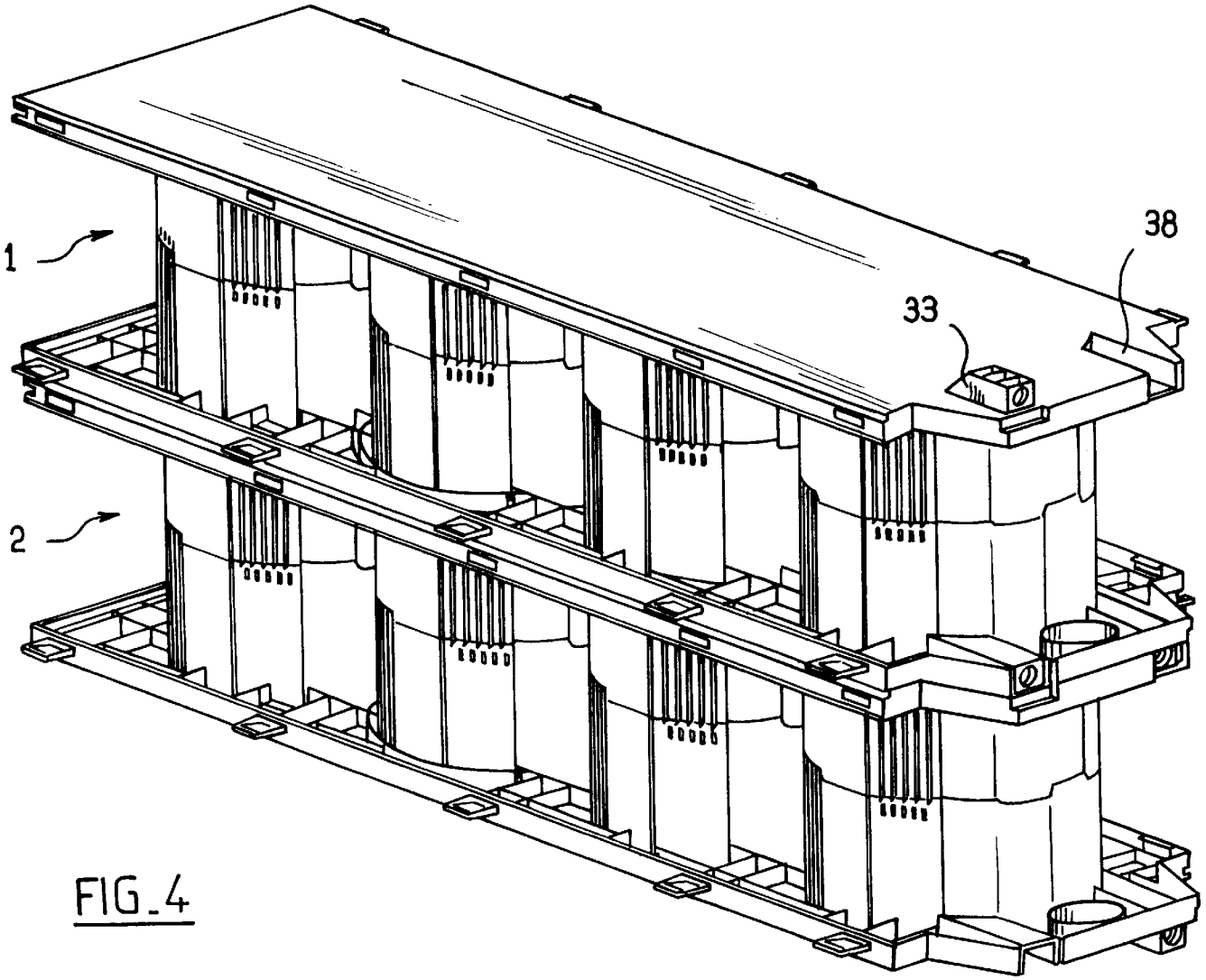
FIG. 4 shows how the elementary blocks can be stacked in a flat position, for storage and transport.

Back to FIG. 4, the elementary blocks with their two identical parts 1*a*, 1*b* assembled, can be stacked on top of one another, the protruding feet 33 of a block fitting in the hollows 38 designed longitudinally symmetrical of an underlying elementary block. This insures a perfect stack formation for storage and transport.

Of course, the volume of the hollows between the bracing structures is calculated so as to allow for the passage of the reinforcing rods (not represented) and for the subsequent pouring of the concrete between these elements, so as to obtain the construction of an autostable, perfectly balanced Civil Engineering work, the volume of the "empty" spaces (in the shafts) vs. the "full" spaces of the irons plus the concrete of the construction being preferably about 40 to 45% of the total volume.

The upper part of the panels displays breakable parts, such as for instance the part 39 in FIG. 1, for the passage of the reinforcement irons with the area surrounding the pool.

Of course, many variants can be added to the embodiment described and illustrated herein, especially concerning the polygonal cylindrical section of the shafts and the cooperating hooking and locking structure elements.

Among the many advantages of this invention, it should be noted that, because of the breakable parts provided in the wall of the blocks, these blocks can be fitted directly in the manufacturing plant with the various desired equipments such as surface skimmer, water return outlet, pool lighting device, etc.

What is claimed is:

1. A block forming a dead form work element for the construction of Civil Engineering works having a mechanically-resistant concrete wall comprising:

an elementary block formed as a rectangular parallelepiped, with a hollow volume for pouring concrete;

said block comprising first and second parts that can be assembled;

said first part having a first main face;

said second part having a second main face;

a first plurality of regularly distributed bracing elements fixedly disposed on said first main face;

a second plurality of regularly distributed bracing elements fixedly disposed on said second main face;

each of said bracing elements being in the shape of a cylindrical shaft, having a polygonal section that is ridged, castellated and lightly stepped radially;

each of said first bracing elements having a first end;

each of said second bracing elements having a second end;

said first part bearing on said second part and interlocking in an assembled position via the first and second ends of said bracing elements; and locking organs consisting of protruding tongues on the first ends equipped with teeth that lock into corresponding hollows on said second ends.

2. The block according to claim 1, wherein a volume of the bracing elements occupies at least 40% of the hollow volume.

3. The block according to claim 1, wherein the said first and second parts are substantially identical.

4. The block according to claim 1, wherein said bracing elements are centered relative to a median longitudinal plane of the elementary block and occupy at least 70% of a width of the elementary block.

5. The block according to claim 1, comprising four said bracing elements.

6. The block according to claim 1, wherein said bracing elements comprise a canal that can house a watertight seal in an edge of said first and second parts that is compressed by a complementary border formed on an adjacent block when assembled.

7. The block according to claim 1, wherein each said first and second main faces comprise markings that delimit breakable parts of the main faces so as to allow for passage of pool operating components.

8. The block according to claim 1, wherein an upper edge is provided with a recess forming a groove to allow for the hookup of a liner.

9. The block according to claim 1, wherein a lower edge is provided with lift jacks.

10. The block according to claim 1, wherein distances between said bracing elements are calculated so as to allow the passage of reinforcing irons and the subsequent pouring of concrete into the hollow volumes and between the bracing elements, so as to achieve the construction of an autostable Civil Engineering work.

11. A block forming a dead form work element for the construction of Civil Engineering works having a mechanically-resistant concrete wall comprising:

an elementary block formed as a rectangular parallelepiped, with a hollow volume for pouring concrete;

said block comprising first and second parts that can be assembled;

said first part having a first main face;

said second part having a second main face;

a first plurality of regularly distributed bracing elements fixedly disposed on said first main face;

a second plurality of regularly distributed bracing elements fixedly disposed on said second main face;

each of said bracing elements being in the shape of a cylindrical shaft, having a polygonal section that is ridged, castellated and lightly stepped radially;

each of said first bracing elements having a first end;

each of said second bracing elements having a second end;

said first part bearing on said second part and interlocking in an assembled position via the first and second ends of said bracing elements; and wherein said first and second parts comprise locking elastic clips cooperating with complementary housings, said clips being formed on said first end and the housings on said second end.

12. A block forming a dead form work element for the construction of Civil Engineering works having a mechanically-resistant concrete wall comprising:

an elementary block formed as a rectangular parallelepiped, with a hollow volume for pouring concrete;

said block comprising first and second parts that can be assembled;

said first part having a first main face;

said second part having a second main face;

a first plurality of regularly distributed bracing elements fixedly disposed on said first main face;

a second plurality of regularly distributed bracing elements fixedly disposed on said second main face;

each of said bracing elements being in the shape of a cylindrical shaft, having a polygonal section that is ridged, castellated and lightly stepped radially;

each of said first bracing elements having a first end;

each of said second bracing elements having a second end;

said first part bearing on said second part and interlocking in an assembled position via the first and second ends of said bracing elements; and wherein each said main face comprises markings that delimit breakable parts of the main face so as to allow for passage of pool operating components.

* * * * *